US006397772B1

(12) United States Patent
Christensen

(10) Patent No.: US 6,397,772 B1
(45) Date of Patent: Jun. 4, 2002

(54) BOAT MOTOR TROLLING ATTACHMENT

(76) Inventor: Dale Christensen, 718 N. 600 East, Firth, ID (US) 83236

( * ) Notice: Subject to any disclaimer, the term of this patent is extended or adjusted under 35 U.S.C. 154(b) by 0 days.

(21) Appl. No.: 09/543,494

(22) Filed: Apr. 6, 2000

(51) Int. Cl.[7] ..... B63H 25/44
(52) U.S. Cl. ..... 114/145 A
(58) Field of Search ..... 114/145 A, 145 R; 440/66

(56) References Cited

U.S. PATENT DOCUMENTS

| | | | | | |
|---|---|---|---|---|---|
| 2,050,336 | A | * | 8/1936 | Karasinski | 114/145 A |
| 2,495,116 | A | * | 1/1950 | McClain | 416/62 |
| 2,719,503 | A | * | 10/1955 | Smith | 114/145 A |
| 3,136,280 | A | * | 6/1964 | Bergum | 114/145 A |
| 3,603,277 | A | * | 9/1971 | Manary et al. | 114/145 A |
| 3,965,839 | A | * | 6/1976 | Lenz | 114/145 A |
| 3,980,035 | A | * | 9/1976 | Johansson | 114/66.5 H |
| 4,026,231 | A | * | 5/1977 | Fedorko | 114/145 A |
| 4,549,498 | A | * | 10/1985 | Meyer et al. | 114/145 |
| 5,090,347 | A | * | 2/1992 | Radi | 114/145 R |
| 5,421,279 | A | * | 6/1995 | Louks et al. | 114/145 A |
| 5,493,990 | A | * | 2/1996 | Dyer | 114/145 |
| 5,645,009 | A | * | 7/1997 | Lexau | 114/274 |
| 5,715,768 | A | * | 2/1998 | Anderson | 114/145 A |
| 5,924,378 | A | * | 7/1999 | Peterson et al. | 114/145 A |

FOREIGN PATENT DOCUMENTS

| | | | | |
|---|---|---|---|---|
| CA | 722417 | * | 11/1965 | 114/145 A |
| GB | 675693 | * | 7/1952 | 114/145 A |

* cited by examiner

*Primary Examiner*—S. Joseph Morano
*Assistant Examiner*—Ajay Vasudeva
(74) *Attorney, Agent, or Firm*—Workman, Nydegger & Sealey

(57) ABSTRACT

The present invention discloses a boat motor trolling attachment for use in conjunction with a boat motor and propeller to achieve effective trolling speeds. The boat motor trolling attachment includes a frame, defining an opening, and attached to a mounting bracket which is secured to the boat motor. Two springs are attached between the frame and the mounting bracket so as to bias the frame into a trolling position wherein the frame is disposed in a plane perpendicular to an axis defined by the propeller. Four control members are disposed horizontally across the opening and rotatably fixed to the frame so that a outflow of water impinging on the control members when the boat motor is in a forward gear automatically causes the control members to rotate in the frame so as to substantially close off the opening and form a continuous surface. The outflow of water generated by the propeller acts on the continuous surface and is transmitted thereby to the boat so as to resist forward motion of the boat. When the boat motor is in a reverse gear, the control members automatically rotate to allow a inflow of water to be generated by the propeller thereby facilitating control and maneuverability of the boat in reverse. At high forward speeds, the outflow of water generated by the propeller overcomes the bias imposed on the frame by the springs and automatically moves the frame to an inoperative position wherein the frame is disposed in a plane substantially parallel to the axis defined by the propeller.

61 Claims, 6 Drawing Sheets

BOAT MOTOR TROLLING ATTACHMENT

BACKGROUND OF THE INVENTION

1. The Field of the Invention

The present invention relates generally to speed control devices for use with boat motors. More particularly, embodiments of the present invention relate to an improved boat motor trolling attachment for use in achieving effective trolling speeds with outboard or inboard/outboard boat motors.

2. The Prior State of the Art

Fishing from boats has been a popular pastime for many years. Typically, fishermen fish from boats in one of several different ways. In one method, the fisherman uses the boat primarily as a means of transportation to a desired fishing area. Upon reaching the fishing area the fisherman shuts off the boat motor and either fishes on the bottom or drifts with the tide, as in the case of saltwater fishermen. With regards to this technique then, the primary purpose of the boat motor is simply to put the fisherman in the desired location.

In another method of fishing commonly known as trolling, the fisherman runs the boat out to a desired location and then slows the boat down so that lures or bait can be moved through the water at a desired speed and depth. The theory behind trolling is that a fish will see the lure or bait moving through the water and will thus be induced to attack the lure or bait, thereby giving the fisherman an opportunity to hook the fish.

In many cases, trolling requires relatively slow boat speeds so that the lures or bait are properly presented to the fish. However, the motors typically found on sport fishing boats are not well suited to achieve the slow boat speeds that effective trolling often demands. Specifically, the typical outboard or inboard/outboard motor is incapable of being throttled down low enough to achieve an effective trolling speed.

The problem of achieving effective trolling speeds with boat motors is not a new one and has plagued fishermen for some time. While attempts have been made to resolve this problem, none of these attempts has been completely effective or satisfactory.

One such attempt at solving this problem has been simply to add an additional motor to the boat. These additional motors, commonly known as trolling motors, are typically low-power motors. The trolling motor is used in place of the boat motor during the trolling operation so that effective trolling speeds can be achieved. Once trolling is complete, the trolling motor is secured and the boat motor is used to move the boat to the next desired location.

While trolling motors are effective in permitting a fisherman to propel the boat through the water at an effective trolling speed, they are problematic in several regards. First, trolling motors can be rather expensive. This problem is particularly acute with relatively larger boats which, because of their size, require relatively larger trolling motors to move the boat at an effective trolling speed. Thus, the fisherman who wants to use his boat for trolling may be forced to incur a significant expenditure in order to do so.

A related problem concerns the maintenance associated with a trolling motor. In particular, use of an additional motor will necessarily increase the amount of time and money spent on maintenance. Thus, the costs associated with a trolling motor are not limited solely to purchase costs but also include maintenance costs as well.

Finally, addition of a trolling motor introduces undesirable operational requirements as well. As previously noted, the typical trolling motor is, by design, used only for trolling. Thus, when the fisherman arrives at the desired location, he has to shut down the boat motor and prepare the trolling motor for operation. When trolling operations have been completed, fishermen must then secure the trolling motor and restart the boat motor. Thus, a fisherman who changes locations frequently throughout the fishing day is forced to spend a significant amount of time switching back and forth between the trolling motor and the boat motor. Clearly, this detracts from the amount of time the fisherman has available for fishing.

As suggested above, the use of trolling motors represents only a partial solution to the problem of achieving effective trolling speeds. Accordingly, other attempts have been made to resolve this problem. These attempts focus primarily on the use of some type of plate, i.e., a trolling plate, disposed aft of the boat propeller.

In operation, the blades of the propeller exert a force on the water in the vicinity of the propeller and the boat reacts by moving forward. With the trolling plate in place however, a portion of the force exerted by the propeller blades on the water is transmitted to the trolling plate, which is attached to the boat. Because the trolling plate is attached to the boat, the force transmitted to it by the propeller tends to resist forward motion of the boat. In this way, the trolling plate effects reduced boat speed. While the use of trolling plates has thus proven effective in assisting boat motors to achieve effective trolling speeds, known trolling plates and the trolling plate deployment mechanisms have proven problematic.

One significant problem with many known trolling plates is that they are mechanically complex and utilize a large number of moving parts. Mechanical complexity clearly contributes to increased production costs for these units. More importantly, however, mechanical complexity increases the likelihood of an operational malfunction. This problem becomes particularly acute in a marine environment where the mechanism is exposed to the corrosive effects of seawater. Also, the presence of a multitude of interconnected and moving parts makes these trolling plate assemblies more susceptible to damage in the event of an impact.

Another disadvantage of known trolling plates is that they do not automatically position themselves, but require operator intervention in order for them to be deployed to the trolling position and/or to the inoperative position. For example, some trolling plates require sudden acceleration of the boat motor in order to lift the trolling plate up to an inoperative position. Thus, the operator of the boat is required to adjust motor speed in order to change the position of the trolling plate. At best, this arrangement is inconvenient. At worst, these designs are dangerous, particularly where the operator is maneuvering the boat in close quarters and sudden accelerations could increase the likelihood of a collision.

Still other trolling plates employ a variety of release mechanisms, all of which require intervention by the boat operator in order to move the trolling plate up to an inoperative position. Again, this type of design is at least inconvenient because it requires action on the part of the boat operator. This problem becomes particularly acute where the boat operator is the sole occupant of a boat, because operation of the trolling plate could prove to be a dangerous distraction when the boat is being operated in heavy seas, in areas congested with boats, and/or in areas where there are dangerous natural obstacles.

As suggested earlier, many existing trolling plate designs also require operator intervention to move the trolling plate into the trolling position. For at least the reasons stated elsewhere herein, the requirement of manual operation to deploy the trolling plate to a trolling position is undesirable.

Finally, damage to trolling plates is likely to occur where the trolling plate design requires manual operation to move the trolling plate upward to an inoperative position. In particular, if the trolling plate is locked in the trolling position or stuck in the trolling position due to a malfunction of the deployment mechanism, the trolling plate is likely to bend and/or break when the boat accelerates to and/or maintains a high rate of speed. Note that this problem can also result where the boat operator simply forgets to move the trolling plate to the inoperative position prior to high speed running. Clearly, a broken or bent trolling plate will be generally ineffective in reducing boat speed to the rate required for effective trolling. Further, a bent or broken trolling plate will necessitate the expense of replacement.

At least one attempt has been made to resolve the problem just described. Specifically, one known trolling plate design employs springs to bias the trolling plate downward into the trolling position. Thus, when the boat accelerates to, and maintains, a relatively high rate of speed, the outflow of water generated by the propeller overcomes the bias imposed by the springs and moves the trolling plate up to an inoperative position, without damaging the trolling plate. As discussed in detail below however, this type of trolling plate design represents only a partial solution.

At least one problem with these types of trolling plates concerns their effect on boat control and maneuverability. As previously discussed, these types of trolling plates are biased downward into a trolling position when the boat is traveling at a relatively slow rate of speed. This is true whether the boat is operating in forward or reverse gear. While the trolling plate clearly produces a desirable effect when the boat is traveling in a forward gear, the trolling plate is detrimental to boat control and maneuverability when the boat is traveling in a reverse gear. Specifically, the trolling plate, biased as it is into the trolling position, tends to impede the inflow of water to the boat motor propeller in such a way that reverse motion of the boat is significantly hindered. This is particularly problematic in situations where the use of reverse gear is required for maneuvering near docks, other boats and/or obstructions in the water.

In view of the foregoing problems, what is needed is an improved boat motor trolling attachment. Specifically, the boat motor trolling attachment should be mechanically simple and employ a minimal number of parts. Further, the boat motor trolling attachment should move between the inoperative and trolling positions automatically without requiring any kind of manual operation or intervention. Finally, the boat motor trolling attachment should allow ready maneuvering of the boat at any speed, and in any gear.

SUMMARY AND OBJECTS OF THE INVENTION

The present invention has been developed in response to the current state of the art, and in particular, in response to these and other problems and needs that have not been fully or completely resolved by currently available boat motor trolling attachments. Thus, it is an overall object of the present invention to provide a boat motor trolling attachment that facilitates achievement of trolling speeds with a boat motor while resolving the aforementioned problems. Embodiments of the present invention are particularly suitable for use with outboard motors and outdrives.

In a preferred embodiment, the boat motor trolling attachment comprises a frame defining an opening. A plurality of control members are disposed across the opening defined by the frame. In a preferred embodiment, the plurality of control members comprise a plurality of louvers rotatably mounted inside the frame. Preferably, the frame is attached to a mounting bracket so that the frame is disposed aft of the boat motor propeller. Two or more springs attached between the frame and the mounting bracket act to bias the frame downward into a trolling position. In a preferred embodiment, relatively high forward speeds of the boat will overcome the bias imposed on the frame by the springs so that the frame is moved automatically up to an inoperative position.

When the boat motor trolling attachment is deployed in the trolling position, the outflow of water generated by the propeller of the boat motor acts to rotate the louvers in such a way that the louvers collectively close off the opening defined by the frame. By so doing, the louvers collectively form a surface upon which a portion of the force generated by the propeller, acts. This force is transmitted to the boat and partially counteracts the forward motion imposed upon the boat by the propeller. Thus, the surface operates to reduce the speed of the boat to the desired trolling speed. Preferably, one of the louvers defines an aperture which permits a portion of the outflow of water generated by the propeller to pass therethrough so as to enhance responsiveness and maneuverability of the boat when the boat motor is in a forward gear. In reverse gear, the louvers rotate in a direction counter to their direction of rotation in forward gear so that the propeller is able to generate an inflow of water and thereby facilitate responsiveness and maneuverability of the boat in reverse gear.

These and other objects, features, and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of embodiments of the invention will be rendered by reference to the appended drawings. Understanding that these drawings simply depict embodiments of the invention and are not therefore to be considered to be limiting of its scope, the invention and its presently understood best mode for making and using the same will be described and explained with additional specificity and detail through the use of the accompanying drawings in which.

DETAILED DESCRIPTION OF VARIOUS EMBODIMENTS

Reference will now be made to figures wherein like structures will be provided with like reference designations. It is to be understood that the drawings are diagrammatic and schematic representations of various embodiments of the invention, and are not to be construed as limiting the invention. Nor are the drawings necessarily drawn to scale.

Figure 1:
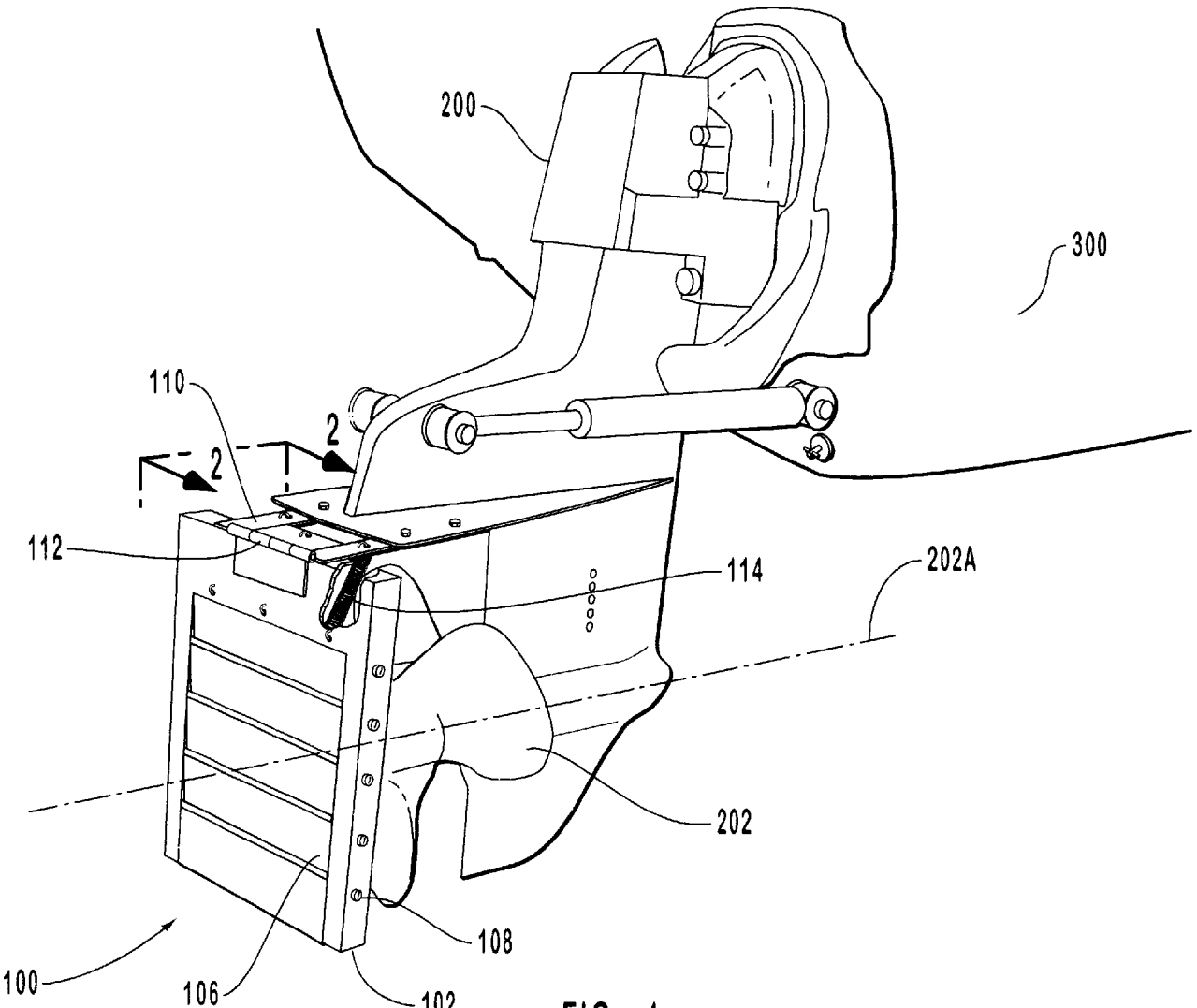
FIG. 1 is a perspective view of one embodiment of the boat motor trolling attachment secured to a boat motor.
Figure 2:
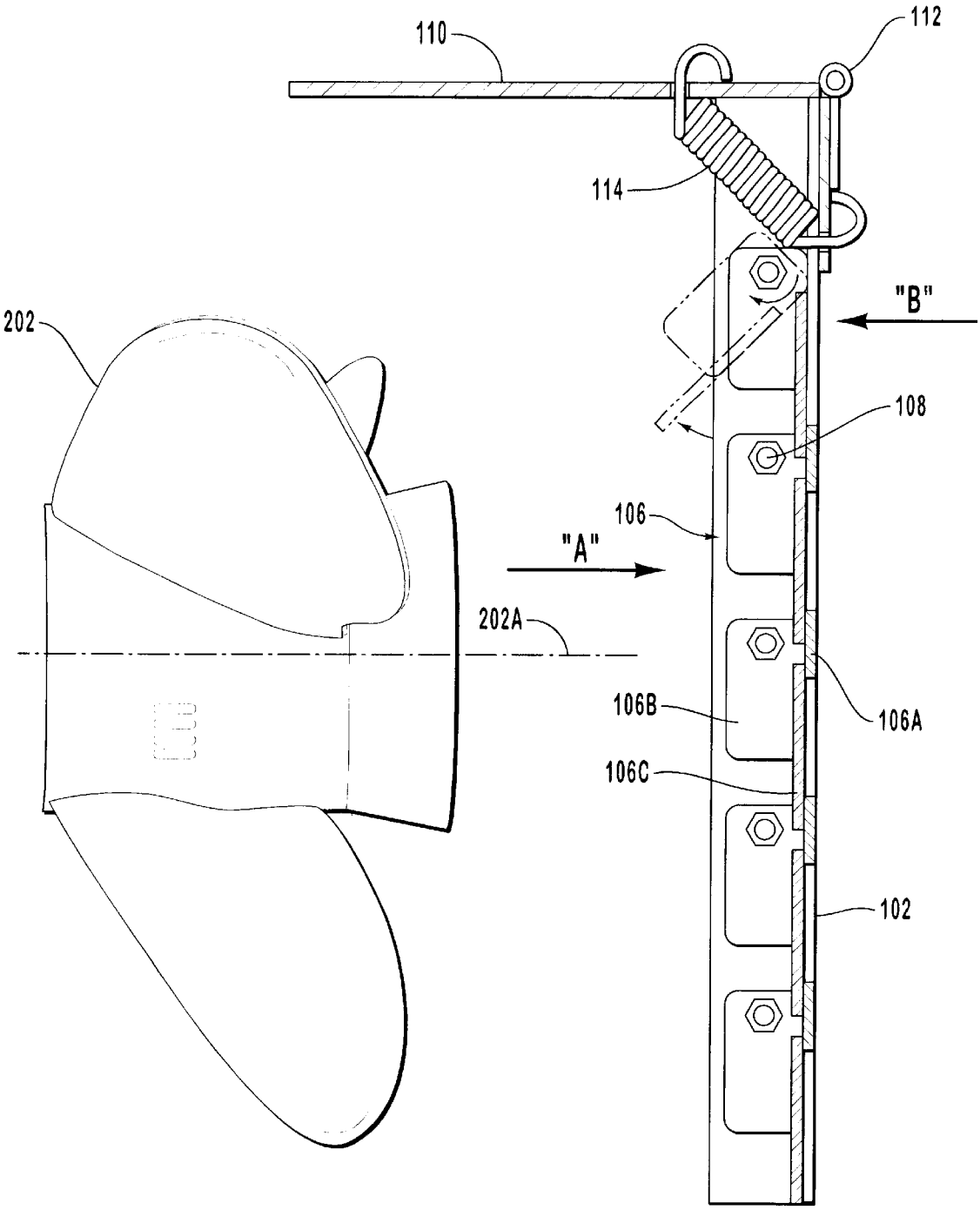
FIG. 2 is a detail of an embodiment of the boat motor trolling attachment indicating the louver arrangement, and the relation between the frame and the mounting bracket.
Figure 3:
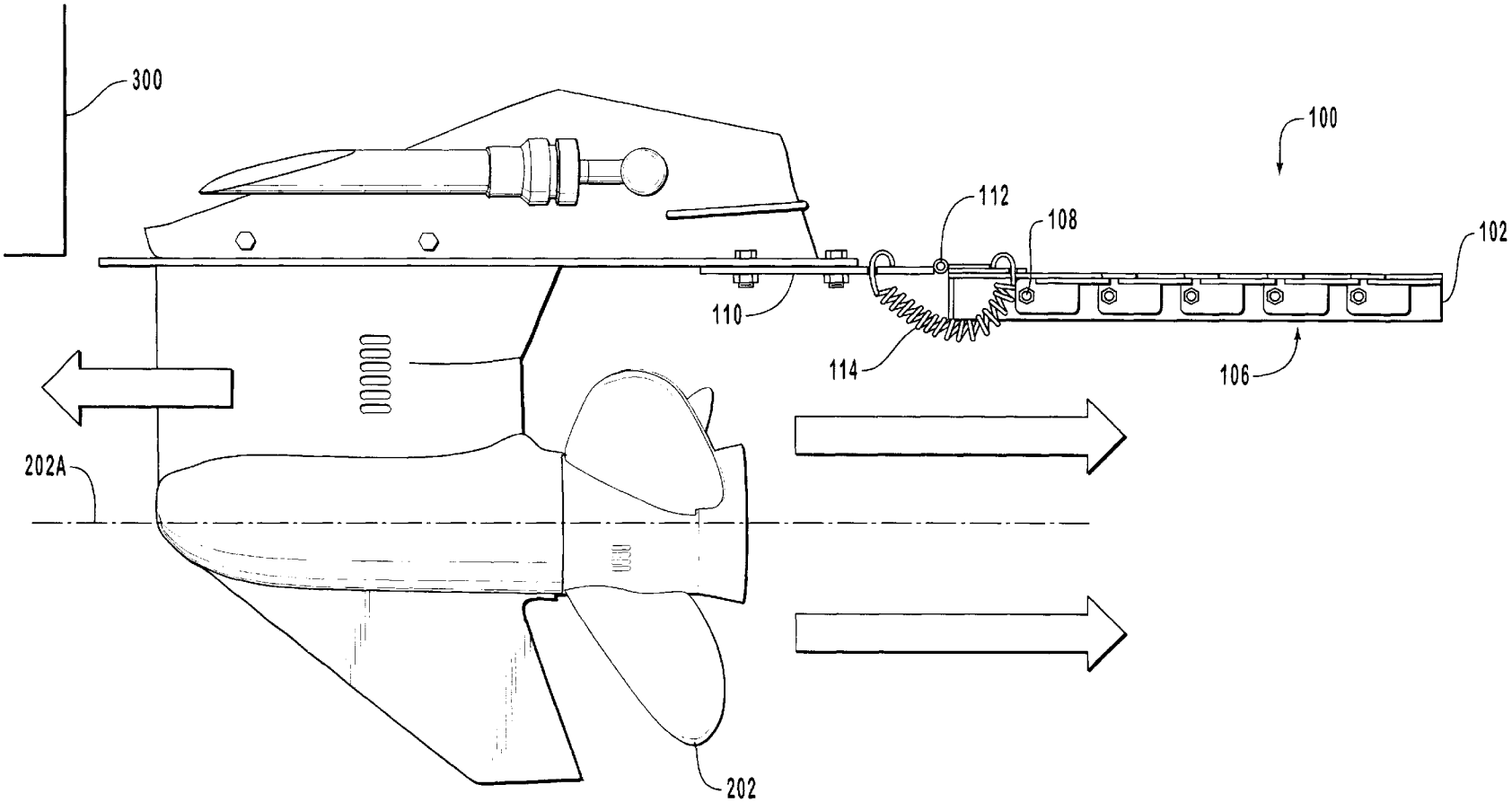
FIG. 3 is a side view indicating the disposition of an embodiment of the boat motor trolling attachment when the boat is traveling forward at a relatively high speed.

In general, the present invention relates to a boat motor trolling attachment for use in achieving effective trolling speeds with a boat motor. FIGS. 1 through 3 indicate various embodiments of a boat motor trolling attachment conforming to the teachings of the invention.

Reference is first made to FIG. 1, which depicts the boat motor trolling attachment, indicated generally as 100, attached to a boat motor 200 which, in turn, is mounted to boat 300. Boat motor trolling attachment 100 includes a frame 102 defining an opening. Frame 102 preferably comprises steel in the shape of angle iron, flat bar, square tube, channel, or the like. However, the present invention contemplates as within its scope any other shape and/or type of material that would provide the functionality of frame 102 as disclosed herein. While FIG. 1 indicates a three sided frame 102, an alternative embodiment of frame 102 comprises a four sided structure, with a bottom, or fourth, side serving to add additional stiffness and structural integrity to frame 102.

Disposed across the opening defined by frame 102 are a plurality of control members 106. As indicated in FIG. 1, one embodiment of control members 106 comprises rotatable louvers, or the like. However, the present invention contemplates as within its scope any other structure and/or devices providing the functionality of control members 106, as disclosed herein. Control members 106 are fixed to frame 102 at regular intervals by means of pins 108 or the like.

Alternatively, pins 108 of control members 106 are fitted into mating openings formed in two rectangular blocks, one rectangular block being disposed on either side of frame 102. Thus mounted, each control member 106 can readily rotate, but lateral motion of control members 106 is substantially prevented. The rectangular blocks preferably comprise plastic or the like, and are slidingly received in mating structure formed in frame 102. In a preferred embodiment, the mating structure comprises square tube or the like. However, any structure providing the functionality disclosed herein is contemplated as being within the scope of the present invention. Finally, the rectangular blocks are retained in place by way of removable pins or the like so that the rectangular blocks and control members 106 may be readily removed. This feature is particularly valuable where a user may wish to remove one or more control members 106 so as to adjust the performance of boat motor trolling attachment 100.

Note that a variety of means may be profitably employed to perform the functions, disclosed herein, of frame 102 and control members 106. Frame 102 and control members 106, collectively, are an example of means for partially counteracting forward travel imposed on a boat by a motor and propeller. Accordingly, the structure disclosed herein simply represents one embodiment of structure capable of performing these functions. It should be understood that this structure is presented solely by way of example and should not be construed as limiting the scope of the present invention in any way.

As further indicated in FIG. 1, frame 102 of boat motor trolling attachment 100 is rotatably attached to mounting bracket 110 by hinge 112. Springs 114, secured at either end to frame 102 and mounting bracket 110, respectively, act to bias frame 102 downward into a trolling position. As contemplated herein, 'trolling position' refers to a position wherein frame 102 is disposed in a plane substantially perpendicular to axis 202A of propeller 202, as indicated in FIG. 1. Mounting bracket 110 is secured to boat motor 200, as indicated in FIG. 1.

Frame 102, control members 106, pins 108, mounting bracket 110, hinge 112, and springs 114 are preferably composed of steel, or the like. However this invention contemplates as within its scope any other material that would provide the same functionality and durability of the materials disclosed herein. It is further contemplated that the present invention may be effectively employed in a marine environment. Accordingly, the present invention contemplates as within its scope the use of boat motor trolling attachment 100 construction materials that are substantially resistant to corrosion by seawater, salt air, and/or other conditions typical of marine environments, while still providing the functionality of boat motor trolling attachment 100, as disclosed herein. Such construction materials contemplated by the present invention include, but are not limited to, copper-nickel alloys, nickel-copper alloys, stainless steel, plastics, or the like.

With reference now to FIG. 2, an embodiment of the present invention is shown in greater detail. As previously noted, boat motor trolling attachment 100 includes a plurality of control members 106. Each control member 106 includes a tab 106A, attachment portion 106B, and control portion 106C. Each control member 106 is rotatably secured to frame 102 by means of pins 108 at attachment portion 106B.

As thus mounted in frame 102, control members 106 collectively act to either permit water flow through the opening defined by frame 102, or substantially block water flow through the opening defined by frame 102. In particular, an outflow of water generated by propeller 202 and moving in direction "A", acts on control portions 106C of control members 106 causing control members 106 to rotate about pins 108 so as to close off the opening defined by frame 102. Note that as contemplated herein, an 'outflow' of water refers to a flow of water generated by propeller 202, and moving away from propeller 202, such as occurs when boat motor 200 is in a forward gear. The location of pin 108 near the top of control member 106 ensures that a force exerted on control portion 106C and in direction "A" will have the desirable effect of rotating control member 106 in such a way as to close off a portion of the opening defined by frame 102.

Thus positioned, each control member 106 acts to close off a portion of the opening defined by frame 102. Further rotation of control members 106 is precluded when control portion 106C of each control member 106 contacts tab 106A of the adjacent control member 106. Frame 102 likewise limits the range of rotation of control members 106. Tabs 106A thus function both to prevent further rotation of an adjacent control member 106 and to cooperate with an adjacent control portion 106C to close off a portion of the opening defined by frame 102.

To briefly summarize then, an outflow of water in direction "A", generated as a result of a force exerted by propeller 202, acts on each control portion 106C of control members 106. In response, control members 106 rotate until their respective control portions 106C contact their respective adjacent tab 106A, control members 106 thus collectively forming a substantially continuous surface closing off at least a portion of the opening defined by frame 102. In a preferred embodiment, the entire opening defined by frame 102 is blocked by control members 106.

Figure 2A:
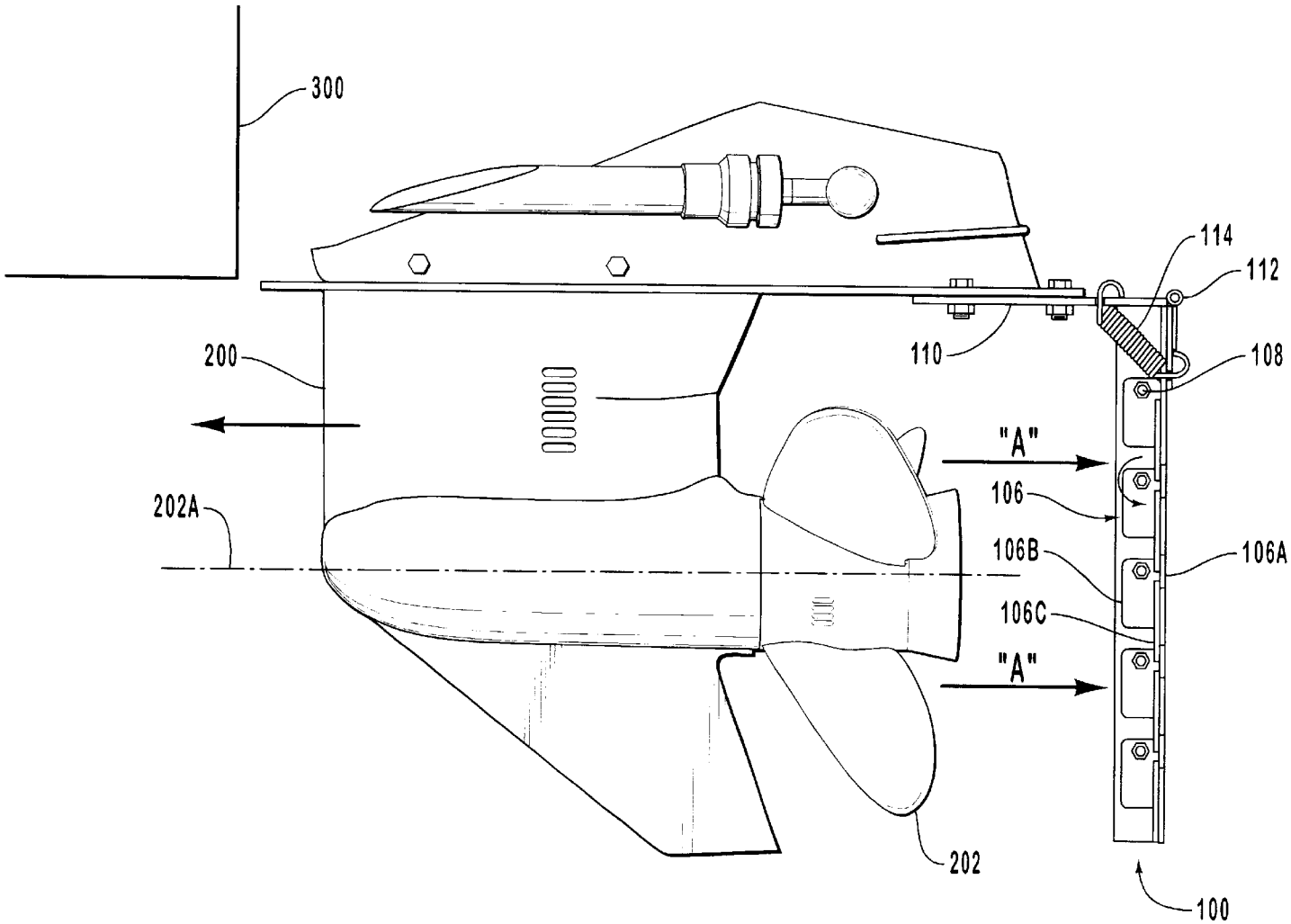
FIG. 2*a* is a side view of an embodiment of the boat motor trolling attachment as it would be disposed during trolling operations.

The effects of the outflow of water in direction "A" are not limited simply to rotating control members 106 so as to close off the opening defined by frame 102. As indicated in FIG. 2*a,* when boat motor 200 is in a forward gear, boat 300 reacts to the force exerted by propeller 202 by moving forward through the water. Further however, the outflow of water generated by propeller 202 acts to transmit a portion of the force exerted by propeller 202 to control portions 106C which, because they are connected to boat 300, transmit that portion of the force to boat 300 in direction "A", and so act to oppose forward motion of boat 300. Boat motor trolling attachment 100 thus acts to partially counteract the forward motion of boat 300 and thereby reduce the forward speed of boat 300 to an effective trolling speed.

In operation then, placement of boat motor 200 in a forward gear, so as to generate an outflow of water from propeller 202, automatically causes control members 106 to rotate to a position wherein the opening defined by frame 102 is substantially closed. Thus, not only is the present invention effective in facilitating trolling speeds, but it also possesses the desirable feature of simplicity of operation. That is, no manual operation or intervention is required by the boat operator, or others, to prepare and/or position boat motor trolling attachment 100 for trolling operations.

Figure 2B:
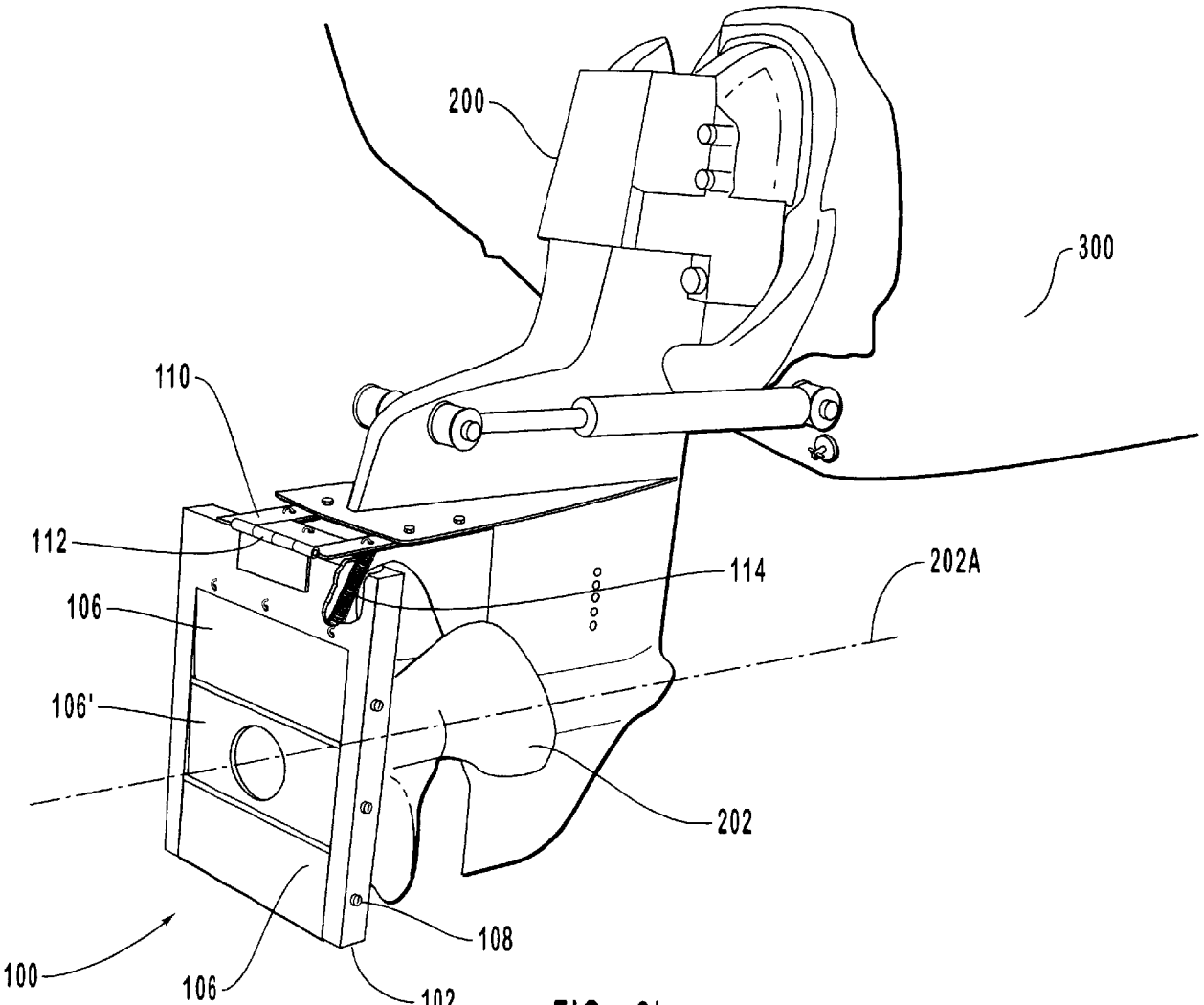
FIG. 2*b* is a perspective view of an alternative embodiment of the boat motor trolling attachment.

Directing attention now to FIG. 2*b,* an alternative embodiment of boat motor trolling attachment 100 is indicated. This embodiment is substantially similar in construction and operation to embodiments of boat motor trolling attachment 100 disclosed elsewhere herein. However, this embodiment includes the additional feature of a control member 106' that defines an aperture which, as discussed below, acts to enhance maneuverability and responsiveness of boat 300 when boat motor 200 is in a forward gear. Generally, the aperture defined by control member 106' is located so that when control members 106 and 106' have rotated into the position required to facilitate achievement of effective trolling speeds by boat 300, a predetermined portion of the outflow of water generated by propeller 202 is nevertheless allowed to pass through control member 106'.

It is well known that a boat depends upon its motor and propeller for acceleration, speed, and maneuverability. The propeller, in turn, is effective because it generates an outflow of water away from the boat, causing the boat to react by moving in a direction opposite the outflow of water thus generated. As discussed elsewhere herein, an obstacle placed in the path of the outflow of water generated by the propeller acts to diminish somewhat the effects of the propeller. Thus, because a portion of the outflow of water generated by propeller 202 is permitted to pass through the aperture defined by control member 106', rather than being blocked by control member 106', the responsiveness and maneuverability of boat 300 are enhanced without materially affecting the functionality of boat motor trolling attachment 100. Note that as contemplated herein, 'responsiveness' refers to the accuracy and speed with which boat 300 responds to steering changes, throttle position changes, and/or gear changes, by the boat operator.

Directing attention now to various specific structural and operational details of the embodiment of boat motor trolling attachment depicted in FIG. 2*b,* two control members 106 and one control member 106' are disposed across the opening defined by frame 102, control member 106' preferably being interposed between the other two control members 106 as indicated in FIG. 2*b*. While this embodiment indicates a total of three control members, it will be appreciated that other numbers of control members would be equally effective in producing the functionality of control members 106 and 106', as disclosed herein. Boat motor trolling attachments 100 employing various numbers of control members 106 and/or 106' are accordingly contemplated as being within the scope of the present invention.

Preferably, control member 106' defines at least one aperture through which a portion of the outflow of water generated by propeller 202 may pass when boat motor 200 is in a forward gear. In a preferred embodiment, the aperture is defined in the center of control member 106'. However, any other arrangements providing the functionality of control member 106', as disclosed herein, are contemplated as being within the scope of the present invention as well. Such arrangements include, but are not limited to, one wherein one or more apertures are cooperatively defined by one or more control members 106 and/or 106'. Preferably, the aperture defined by control member 106' is circular in shape and is aligned with axis 202A of boat motor 200 as indicated in FIG. 2*b*.

Note that the location, shape, size, and number of apertures may be varied as necessary to produce a desired effect on the maneuverability and responsiveness of boat 300, when boat motor 200 is in a forward gear. The present invention accordingly contemplates as within its scope any other structure and/or devices that will provide the functionality of control members 106 and 106', as disclosed herein.

Figure 2C:
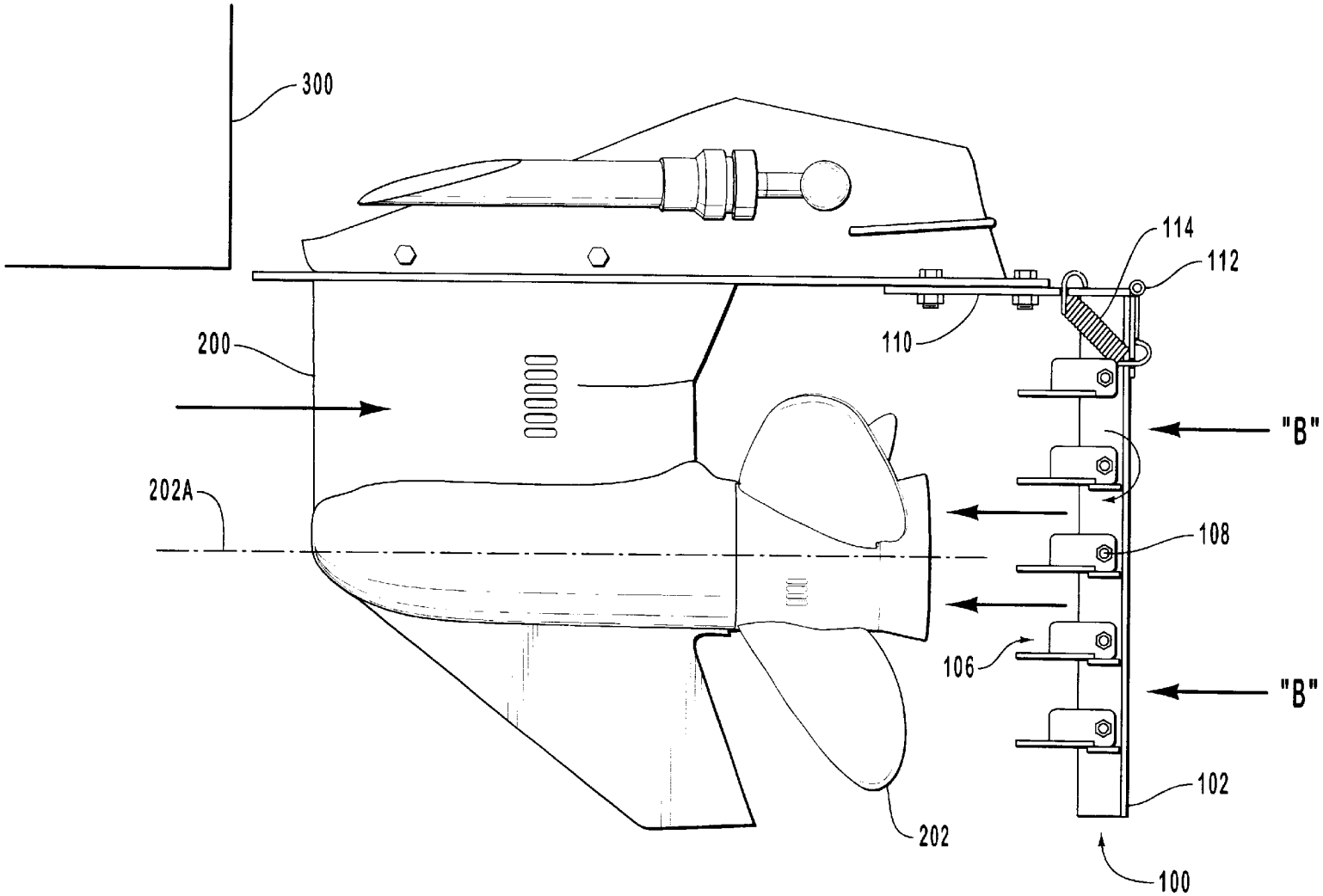
FIG. 2*c* is a side view indicating the disposition of an embodiment of the boat motor trolling attachment when the boat is moving in reverse gear.

With reference now to FIG. 2*c,* and with continuing reference to FIG. 2, the operation of boat motor trolling attachment 100 when boat motor 200 is in a reverse gear is indicated in further detail. An inflow of water in direction "B" acts to automatically rotate control members 106 in such a way that control members 106 will admit water through the opening defined by frame 102, to propeller 202. Note that as contemplated herein, an 'inflow' of water refers to a flow of water generated by propeller 202, and moving towards propeller 202, such as occurs when boat motor 200 is in a reverse gear. Free flow of water to propeller 202 is essential to assure maneuverability and responsiveness of boat 300 when boat motor 200 is in a reverse gear. By permitting propeller 202 to develop an inflow of water when boat 300 is moving in reverse gear, boat motor trolling attachment 100 thus facilitates maneuverability and responsiveness of boat 300 in reverse gear.

Another important feature of boat motor trolling attachment 100 is that rotation of control members 106, so as to permit generation of an inflow of water by propeller 202 and thereby facilitate reverse gear maneuvering and responsiveness, occurs automatically upon reverse motion of boat 300. Thus, no manual operation or intervention by the boat operator, or others, is required to prepare and/or position boat motor trolling attachment 100 in such a way as to facilitate maneuverability and responsiveness of boat 300 when boat motor 200 is in reverse gear.

The effects imposed by boat motor trolling attachment 100 are desirably limited to a predetermined range of speeds. At high forward boat speeds, such as suggested in FIG. 3, the outflow of water generated by propeller 202 acts to overcome the bias imposed on frame 102 by springs 114. Specifically, the outflow of water generated by propeller 202 acts to rotate control members 106 so as to close off the opening defined by frame 102. As previously noted, the outflow of water generated by propeller 202 not only rotates control members 106 so as to close off the opening defined by frame 102, but also exerts a force on control members 106. At high speeds, the force thus exerted is sufficient to overcome the bias imposed by springs 114 and move frame 102 into a substantially horizontal, or inoperative, position with respect to axis 202A defined by propeller 202, as indicated in FIG. 3. In a preferred embodiment, boat motor trolling attachment further includes a limiter that serves to restrict the rotational motion of frame 102 to a desired range, preferably about 90 degrees.

An important feature of the present invention then is that boat motor trolling attachment 100 is automatically moved from a trolling position wherein it partially counteracts forward motion of boat 300, to an inoperative position wherein it has no significant effect on forward motion of boat 300, when a relatively high forward boat speed is achieved. In a substantially similar fashion, when the forward speed of boat 300 is reduced to the point that the bias imposed by springs 114 overcomes the force imposed on control members 106 by the outflow of water generated by propeller 202, boat motor trolling attachment 100 is automatically moved by springs 114 to the trolling position. No manual operation or intervention is required to effect the transition from trolling position to inoperative position, or to effect the transition from inoperative position to trolling position, these transitions occur automatically when boat 300 reaches a predetermined speed. Note that when it is in the inoperative position, boat motor trolling attachment 100 lends a slight hydrofoil effect that may counteract any drag that it otherwise imposes, and thus it has no detrimental effect on the forward speed of boat 300.

Note as well that the range of speeds over which boat motor trolling attachment 100 is effective may desirably be modified by varying the numbers and/or stiffness of springs 114. Also, by varying the number and/or stiffniess of springs 114, boat motor trolling attachment 100 can be readily adapted for effective use with variously powered boat motors. Finally, note that any other structure and/or devices providing the functionality of springs 114, as disclosed herein, is contemplated as being within the scope of the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A boat motor trolling attachment suitable for use in conjunction with a boat and a boat motor, the boat motor having a propeller and including a forward gear and a reverse gear, comprising:

(a) a mounting bracket configured for attachment to the boat motor;

(b) a frame defining an opening, said frame depending from said mounting bracket;

(c) at least one resilient member operably interconnected between said mounting bracket and said frame, said at least one resilient member biasing said frame into a trolling position; and (d) at least one control member disposed across said opening, said at least one control member transmitting a portion of a force exerted by the propeller to the boat so as to at least partially counteract forward travel and reduce speed of the boat when the boat motor is in the forward gear, and said at least one control member permitting an inflow of water through said opening to the propeller so as to facilitate maneuverability and responsiveness of the boat when the boat motor is in the reverse gear.

2. The boat motor trolling attachment as recited in claim 1, wherein said frame moves into an inoperative position when said portion of said force exerted by the propeller overcomes said biasing of said frame by said at least one resilient member.

3. The boat motor trolling attachment as recited in claim 1, wherein said frame is rotatably secured to said mounting bracket.

4. The boat motor trolling attachment as recited in claim 1, wherein said at least one control member comprises a plurality of louvers disposed across said opening and rotatably mounted to said frame, said plurality of louvers rotating so as to collectively form a substantially continuous surface substantially closing off said opening when the boat motor is placed in the forward gear.

5. The boat motor trolling attachment as recited in claim 4, wherein rotation of said plurality of louvers occurs automatically upon placement of the boat motor into the forward gear.

6. The boat motor trolling attachment as recited in claim 4, wherein said plurality of louvers rotate so as to permit an inflow of water therebetween when the boat motor is placed in the reverse gear.

7. The boat motor trolling attachment as recited in claim 6, wherein rotation of said plurality of louvers to allow an inflow of water therebetween occurs automatically upon placement of the boat motor into the reverse gear.

8. The boat motor trolling attachment as recited in claim 1, wherein said mounting bracket is configured to be removably attached to the boat motor.

9. The boat motor trolling attachment as recited in claim 1, wherein said at least one control member defines at least one aperture which permits a portion of an outflow of water generated by the propeller to pass therethrough so as to enhance maneuverability and responsiveness of the boat when the boat motor is in the forward gear.

10. The boat motor trolling attachment as recited in claim 9, wherein said at least one aperture has a center substantially aligned with a substantially horizontal axis defined by the propeller.

11. The boat motor trolling attachment as recited in claim 9, wherein said at least one aperture is substantially circular in shape.

12. The boat motor trolling attachment as recited in claim 1, wherein said frame is in substantially the same position, relative to the propeller, when said at least one control member is transmitting said portion of said force exerted by the propeller to the boat as when said at least one control member is permitting an inflow of water through said opening to the propeller.

13. The boat motor trolling attachment as recited in claim 12, wherein said frame is disposed in a plane substantially perpendicular to an axis of the propeller.

14. The boat motor trolling attachment as recited in claim 1, wherein said at least one control member automatically shifts from at least partially counteracting forward travel of the boat to permitting an inflow of water through said opening, upon shifting of the boat motor from the forward to the reverse gear.

15. The boat motor trolling attachment as recited in claim 1, wherein said at least one control member automatically shifts from permitting an inflow of water through said opening to at least partially counteracting forward travel of the boat, upon shifting the boat motor from the reverse to the forward gear.

16. A boat motor trolling attachment suitable for use in conjunction with a boat and a boat motor, the boat motor having a propeller and including a forward and reverse gear, comprising:

(a) a mounting bracket;

(b) a frame attached to said mounting bracket and defining an opening; and (c) at least one louver disposed across said opening defined by said frame, said at least one louver being rotatably mounted to said frame and said at least one louver rotating so as to form a substantially continuous surface at least partially closing off said opening when the boat motor is placed in the forward gear, said substantially continuous surface transmitting a portion of a force exerted by the propeller to the boat so as to partially counteract forward travel of the boat when the boat is in the forward gear, and said at least one louver cooperating with the boat motor and propeller of the boat to facilitate maneuverability and responsiveness of the boat when the boat motor is in the reverse gear.

17. The boat motor trolling attachment as recited in claim 16, wherein said at least one louver defines at least one aperture which permits a portion of an outflow of water generated by the propeller to pass therethrough so as to enhance maneuverability and responsiveness of the boat when the boat motor is in the forward gear.

18. A boat motor trolling attachment, comprising:

(a) a mounting bracket;

(b) a frame defining an opening, said frame being rotatably attached to said mounting bracket and having at least one resilient member attached to said mounting bracket, said at least one resilient member biasing said frame into a trolling position; and (c) a plurality of rotatable louvers disposed horizontally across said opening, said plurality of rotatable louvers rotating in a first direction so as to collectively form a surface when the boat motor is in a forward gear, said surface transmitting a portion of a force exerted by a propeller of the boat motor to the boat so as to resist forward motion thereof, and said plurality of rotatable louvers rotating in a second direction when the boat motor is in a reverse gear so as to permit an inflow of water between said plurality of rotatable louvers to said propeller and facilitate maneuvering and responsiveness of the boat.

19. The boat motor trolling attachment as recited in claim 18, wherein said trolling position comprises a plane aft of the propeller and substantially perpendicular to an axis defined by the propeller.

20. The boat motor trolling attachment as recited in claim 18, wherein rotation of said plurality of louvers to allow an inflow of water therebetween occurs automatically upon placement of the boat motor into said reverse gear.

21. The boat motor trolling attachment as recited in claim 18, wherein rotation of said plurality of louvers to form said surface occurs automatically upon placement of the boat motor into said forward gear.

22. The boat motor trolling attachment as recited in claim 18, wherein said frame moves into a plane substantially parallel to an axis defined by the propeller when said portion of said force exerted by the propeller overcomes said biasing imposed upon said frame by said at least one resilient member.

23. The boat motor trolling attachment as recited in claim 18, wherein said surface is substantially continuous.

24. The boat motor trolling attachment as recited in claim 18, wherein at least one of said plurality of rotatable louvers defines at least one aperture which permits a portion of an outflow of water generated by the propeller to pass therethrough so as to enhance maneuverability and responsiveness of the boat when the boat motor is in said forward gear.

25. The boat motor trolling attachment as recited in claim 18, wherein said at least one aperture has a center substantially aligned with an axis of said propeller.

26. The boat motor trolling attachment as recited in claim 18, wherein at least two of said plurality of rotatable louvers collectively define at least one aperture which permits a portion of an outflow of water generated by the propeller to pass therethrough so as to facilitate maneuverability and responsiveness of the boat when the boat motor is in a forward gear.

27. A boat motor trolling attachment suitable for use in conjunction with a boat and a boat motor, the boat motor having a propeller and including a forward gear and a reverse gear, comprising:

(a) a mounting bracket;

(b) a frame depending from said mounting bracket and defining an opening; and (c) at least one control member configured and arranged to substantially close off said opening when the boat motor is in the forward gear, and said at least one control member being configured and arranged to define at least one flow path through said frame when the boat motor is in the reverse gear.

28. The boat motor trolling attachment as recited in claim 27, wherein said at least one control member comprises at least one rotatable louver.

29. The boat motor trolling attachment as recited in claim 27, wherein said at least one control member defines at least one aperture.

30. The boat motor trolling attachment as recited in claim 27, further comprising at least one resilient member connected between said frame and said mounting bracket.

31. The boat motor trolling attachment as recited in claim 30, wherein said at least one resilient member biases said frame into a trolling position.

32. The boat motor trolling attachment as recited in claim 27, wherein said frame is rotatably secured to said mounting bracket.

33. The boat motor trolling attachment as recited in claim 27, wherein said frame is in substantially the same position, relative to the propeller, when said at least one control member has substantially closed off said opening as when said at least one control member has defined said at least one flow path through said frame.

34. The boat motor trolling attachment as recited in claim 33, wherein said position in which said frame is disposed comprises a plane substantially perpendicular to an axis defined by the propeller.

35. The boat motor trolling attachment as recited in claim 27, wherein said at least one control member comprises a plurality of louvers disposed across said opening and rotatably mounted to said frame.

36. The boat motor trolling attachment as recited in claim 27, wherein said at least one control member at least partially counteracts forward travel of the boat when the boat motor is in the forward gear.

37. The boat motor trolling attachment as recited in claim 27, wherein said at least one control member aids in maneuverability of the boat when the boat motor is in the reverse gear.

38. The boat motor trolling attachment as recited in claim 27, wherein said at least one control member, in response to shifting of the boat motor from the forward gear to the reverse gear, automatically moves from substantially closing off said opening to defining at least one flow path.

39. The boat motor trolling attachment as recited in claim 27, wherein said at least one control member, in response to shifting of the boat motor from the reverse gear to the forward gear, automatically moves from defining at least one flow path to substantially closing off said opening.

40. The boat motor trolling attachment as recited in claim 27, wherein said frame automatically moves from a trolling position to an inoperative position at a predetermined boat speed.

41. The boat motor trolling attachment as recited in claim 27, wherein said frame automatically moves from an inoperative position to a trolling position at a predetermined boat speed.

42. A boat motor trolling attachment suitable for use in conjunction with a boat and a boat motor, the boat motor having a propeller and including a forward gear and a reverse gear, comprising:

(a) a mounting bracket;

(b) a frame defining an opening, said frame being rotatably attached to said mounting bracket and having at least one resilient member attached to said mounting bracket, said at least one resilient member biasing said frame into a trolling position; and (c) a plurality of rotatable louvers disposed horizontally across said opening, said plurality of rotatable louvers rotating in a first direction so as to collectively form a surface when the boat motor is in the forward gear, said surface transmitting a portion of a force exerted by the propeller of the boat motor to the boat so as to resist forward motion thereof, and said plurality of rotatable louvers rotating in a second direction when the boat motor is in the reverse gear so as to permit an inflow of water between said plurality of rotatable louvers to said propeller and facilitate maneuvering and responsiveness of the boat.

43. The boat motor trolling attachment as recited in claim 42, wherein rotation of said plurality of louvers to allow an inflow of water therebetween occurs automatically upon placement of the boat motor into the reverse gear.

44. The boat motor trolling attachment as recited in claim 42, wherein rotation of said plurality of louvers to form said surface occurs automatically upon placement of the boat motor into the forward gear.

45. A boat motor trolling attachment suitable for use in conjunction with a boat and a boat motor, the boat motor having a propeller and including a forward gear and a reverse gear, comprising:

(a) a mounting bracket;

(b) a frame depending from said mounting bracket and defining an opening; and (c) at least one control member constructed to assume alternative configurations, wherein in a first configuration said at least one control member substantially closes off said opening, and wherein in a second configuration said at least one control member defines at least one flow path through said frame, said at least one control member being in said first configuration when the boat motor is in the forward gear and said at least one control member being in said second configuration when the boat motor is in the reverse gear.

46. The boat motor trolling attachment as recited in claim 45, wherein when said at least one control member is in said first configuration, said at least one control member forms a substantially continuous surface.

47. The boat motor trolling attachment as recited in claim 46, wherein said substantially continuous surface transmits to the boat a portion of a force exerted by the propeller of the boat motor, so as to resist forward motion of the boat.

48. The boat motor trolling attachment as recited in claim 45, wherein when said at least one control member is in said second configuration, said at least one control member defines at least one flow path through said frame.

49. The boat motor trolling attachment as recited in claim 48, wherein said at least one flow path permits an inflow of water to the propeller.

50. The boat motor trolling attachment as recited in claim 45, wherein said at least one control member automatically changes from said first configuration to said second configuration when the boat motor is shifted from the forward gear to the reverse gear.

51. The boat motor trolling attachment as recited in claim 45, wherein said at least one control member automatically changes from said second configuration to said first configuration when the boat motor is shifted from the reverse gear to the forward gear.

52. The boat motor trolling attachment as recited in claim 45, wherein said frame automatically moves from a trolling position to an inoperative position at a predetermined boat speed.

53. The boat motor trolling attachment as recited in claim 45, wherein said frame automatically moves from an inoperative position to a trolling position at a predetermined boat speed.

54. The boat motor trolling attachment as recited in claim 45, wherein said at least one control member comprises a plurality of louvers disposed across said opening and rotatably mounted to said frame.

55. The boat motor trolling attachment as recited in claim 54, wherein said plurality of louvers rotate so as to collectively form a surface that closes off said opening when the boat motor is in the forward gear.

56. The boat motor trolling attachment as recited in claim 54, wherein said plurality of louvers rotate so as to permit an inflow of water therebetween when the boat motor is in the reverse gear.

57. The boat motor trolling attachment as recited in claim 45, further comprising at least one resilient member interconnected between said mounting bracket and said frame.

58. The boat motor trolling attachment as recited in claim 57, wherein said at least one resilient member biases said frame into a trolling position.

59. The boat motor trolling attachment as recited in claim 45, wherein said at least one control member defines at least one aperture.

60. The boat motor trolling attachment as recited in claim 45, wherein when said at least control member is in said first configuration, said at least one control member at least partially counteracts forward travel of the boat.

61. The boat motor trolling attachment as recited in claim 45, wherein when said at least control member is in said second configuration, said at least one control member aids in maneuverability of the boat.

* * * * *